US011304469B2

(12) United States Patent
Redpath et al.

(10) Patent No.: US 11,304,469 B2
(45) Date of Patent: Apr. 19, 2022

(54) HELMETS INCLUDING SPRAY ON MATERIALS

(71) Applicant: Galvion Ltd., Portsmouth, NH (US)

(72) Inventors: David Redpath, Beaconsfield (CA); Marie-Pierre Gendron, Mercier (CA); Curtis Herman, Montreal (CA)

(73) Assignee: Galvion Ltd., Portsmouth, NH (US)

( * ) Notice: Subject to any disclaimer, the term of this patent is extended or adjusted under 35 U.S.C. 154(b) by 206 days.

(21) Appl. No.: 15/676,802

(22) Filed: Aug. 14, 2017

(65) Prior Publication Data

US 2018/0020759 A1 Jan. 25, 2018

Related U.S. Application Data

(62) Division of application No. 13/931,162, filed on Jun. 28, 2013, now abandoned.

(51) Int. Cl.
*A42B 3/04* (2006.01)
*A42B 3/06* (2006.01)

(52) U.S. Cl.
CPC ..... *A42B 3/04* (2013.01); *A42B 3/061* (2013.01)

(58) Field of Classification Search
CPC ..... A42B 3/04; A42B 3/003; A42B 3/061; A42B 3/30; B05C 21/005; B05B 12/16; B05B 12/20; B05B 12/22; B05B 12/24; B05B 12/26; B05B 12/28; B05B 12/29
USPC ..... 427/282, 284; 118/301, 504
See application file for complete search history.

(56) References Cited

U.S. PATENT DOCUMENTS

| | | | | |
|---|---|---|---|---|
| 2,339,189 | A | 1/1944 | Pickles et al. | |
| 3,116,490 | A | 1/1964 | Zbikowski | |
| 3,155,981 | A * | 11/1964 | McKissick | A42B 3/003 2/422 |
| 3,245,087 | A | 4/1966 | Marchello | |
| 3,665,514 | A | 5/1972 | Durand | |
| 3,729,745 | A | 5/1973 | Latina | |
| 5,732,414 | A * | 3/1998 | Monica | A42B 3/003 2/209.13 |
| 5,814,398 | A | 9/1998 | Traxler et al. | |
| 6,533,189 | B2 | 3/2003 | Kott et al. | |
| 6,803,005 | B2 | 10/2004 | Dennis et al. | |
| 2003/0200597 | A1 * | 10/2003 | Dennis | A42B 3/063 2/410 |
| 2006/0248827 | A1 | 11/2006 | Meeker | |
| 2009/0044319 | A1 | 2/2009 | Lamson et al. | |

(Continued)

OTHER PUBLICATIONS

U.S. Appl. No. 13/931,162, filed Jun. 28, 2013, Redpath et al.

(Continued)

*Primary Examiner* — Sally Haden
(74) *Attorney, Agent, or Firm* — Wolf, Greenfield & Sacks, P.C.

(57) ABSTRACT

Various embodiments of helmets and methods of their manufacture are disclosed. In some embodiments, the helmet includes a helmet shell having a helmet shell edge and/or a mounting location for mounting an accessory to the helmet shell. A material that is adherent to the helmet shell may be sprayed onto the helmet shell edge of the helmet shell to form a trim. Alternatively, the material may be sprayed onto a portion of the helmet shell associated with either a mounting location for mounting an accessory or a position for a mounted accessory.

23 Claims, 3 Drawing Sheets

(56) References Cited

U.S. PATENT DOCUMENTS

| | | | | |
|---|---|---|---|---|
| 2009/0064386 | A1* | 3/2009 | Rogers | A42B 3/125 2/6.6 |
| 2012/0192337 | A1* | 8/2012 | Divine | A42B 1/08 2/414 |
| 2015/0000011 | A1 | 1/2015 | Redpath et al. | |

OTHER PUBLICATIONS

PCT/IB2014/002276, Feb. 2, 2015, Invitation to Pay Additional Fees.
PCT/IB2014/002276, May 20, 2015, International Search Report and Written Opinion.
PCT/IB2014/002276, Jan. 7, 2016, International Preliminary Report on Patentability.
Invitation to Pay Additional Fees for PCT/IB2014/002276 dated Feb. 2, 2015.
International Search Report and Written Opinion for Application No. PCT/IB2014/002276, dated May 20, 2015.
International Preliminary Report on Patentability for PCT/IB2014/002276 dated Jan. 7, 2016.
[No Author Listed], Bond+define—Google Search. N.p., n.d. Web. Apr. 7, 2017.

* cited by examiner

HELMETS INCLUDING SPRAY ON MATERIALS

CROSS-REFERENCE TO RELATED APPLICATIONS

This application is a divisional and claims the benefit under 35 U.S.C. § 120 of U.S. application Ser. No. 13/931,162, filed on Jun. 28, 2013, which is herein incorporated by reference in its entirety.

FIELD

Helmets including spray on materials.

BACKGROUND

Helmets are used in any number of applications to help prevent, or reduce the severity of, head injuries. These applications include military helmets, motorcycle helmets, bike helmets, skateboard helmets, and snowboard helmets to name just a few. In some instances, these helmets are made using composite materials to provide enhanced performance characteristics. However, helmets are subject to impacts and abrasion during use and handling. This may be of concern along certain portions of a composite helmet such as along the helmet shell edges which may be subject to delamination, chipping, cutting, and/or abrasion of the layers present within the composite material. To mitigate such damage to the composite material along the helmet shell edges, helmets oftentimes include a trim made from an elastomeric material disposed on the helmet shell edge.

Typically, the trim is made from a dense synthetic rubber and is usually provided in one of two separate ways. In the first, a gasket is provided as a linear strip with a groove shaped therein to accept an edge of the helmet shell. The rubber gasket is deformed to follow the helmet shell edge when it is attached to the helmet shell which creates stresses in the gasket. The second typical type of trim is separately molded to a shape corresponding to a shape of the helmet shell. Since the molded trim is subject to tolerances inherent in the molding process as well as the molded trim design, it does not perfectly follow the shape of the helmet shell. Both the rubber gasket and molded trim use an adhesive for attachment to the helmet shell.

SUMMARY

In one embodiment, a helmet includes a helmet shell having an edge and a sprayed on trim directly adhered to the helmet shell and covering the helmet shell edge.

In another embodiment, a method of manufacturing a helmet includes spraying an adherent material onto a helmet shell edge of a helmet shell to form a trim along the helmet shell edge.

In yet another embodiment, a helmet includes a helmet shell having a mounting location for mounting an accessory to the helmet shell. A sprayed on material is directly adhered to a portion of the helmet shell associated with either the mounting location or a position for a mounted accessory. A coefficient of friction of the material is greater than a coefficient of friction of the helmet shell.

In another embodiment, a method of manufacturing a helmet includes spraying a material onto a portion of a helmet shell associated with either a mounting location for mounting an accessory or a position for a mounted accessory, wherein a coefficient of friction of the material is greater than a coefficient of friction of the helmet shell.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 2:
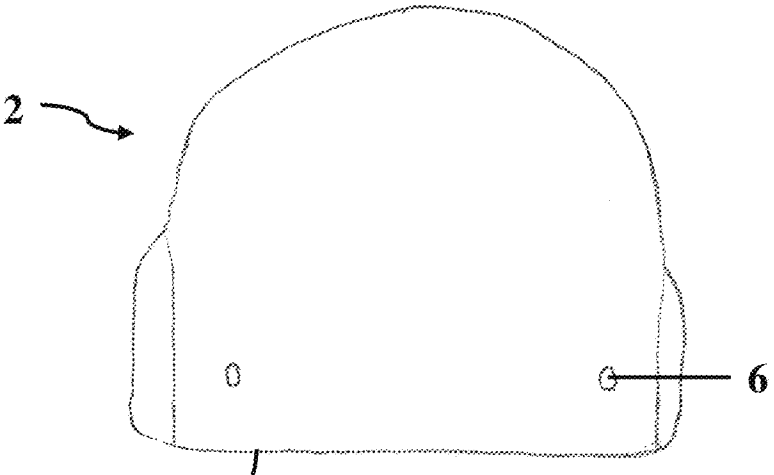
FIG. 2 is a schematic rear plan view of a bare helmet shell.

The inventors have recognized that conventional rubber gaskets and molded trims are relatively thick and heavy. These conventional types of trim may also be prone to delamination due to the above noted tolerances and stresses associated with these trims. The adhesives generally used with these trims also have relatively long cure times which coupled with positioning the helmet, applying the adhesive, and applying the trim result in a relatively labor-intensive process. Therefore, the inventors have recognized that it is desirable to provide a trim with increased strength, increased durability, increased adhesion with the helmet shell, reduced weight, and/or improved ease of manufacture. In view of the above, the inventors have recognized the benefits associated with applying a material directly to the helmet shell without the need to separately form and adhere a component to the helmet shell. Without wishing to be bound by theory, possible benefits associated with sprayed on materials as compared to the separate rubber gasket and molded trims noted above include, but are not limited to, continuous coverage, conforming to the contours of the underlying helmet shell, increased material strengths, thinner trims, decreased weight, reduced setup and processing times, the elimination of a separate adhesive to bond the materials to the helmet shell, increased abrasion resistance, increased chemical resistance, and/or increased flammability resistance.

It should be understood that any material capable of being sprayed onto, and adhering to, the helmet may be used with the currently disclosed embodiments. However, for the sake of clarity, the embodiments below are described with regards to a sprayed on polymeric material.

While any number of different methods might be employed to apply a polymeric material directly to the helmet shell, in one embodiment, a polymeric material is sprayed directly onto the desired portions of the helmet shell. As described in more detail below, appropriate masking techniques may be used to limit application of the sprayed on layer of polymeric material to the desired portions of the helmet shell. Thus, it is possible to form specific components in one, or a plurality of, desired locations with a desired shape by spraying the polymeric material onto only particular portions of the helmet. For example, and as described in more detail below, a sprayed on polymeric material might be used to form a trim disposed along the helmet shell edge, or it may be used to form patches of polymeric material associated with mounting portions of the helmet shell to increase the friction between the helmet and any attached accessories. The above noted sprayed on polymeric materials result in reduced processing times and cost savings in addition to the enhanced properties associated with many sprayed on polymeric materials. Additionally, due to the sprayed on application, the polymeric material may also exhibit substantially continuous coverage that conforms to the shape of the underlying helmet shell regardless of the presence of sharp turns and other features which may reduce the presence of weak joining points with the helmet shell.

It should be understood, that any appropriate polymeric material capable of being sprayed, and that is adherent to the helmet shell, may be used. Further, the polymeric material may be selected such that it has an appropriate gel and cure time to enable the polymeric material to be applied to sides of the helmet shell, and even possibly overhanging portions of the helmet shell without significant running or dripping. For example, the gel time, also known as the working time, of a polymeric material might be on the order of about 5 seconds to about 10 seconds. However, other appropriate gel times and cure times that are shorter or longer are also possible. The polymeric material may also be selected for desired physical properties of the final product. Examples of desirable physical properties include, but are not limited to, strength, density, coefficient of friction, abrasion resistance, chemical resistance, and flammability resistance. In one exemplary embodiment, a material might be selected that has a higher strength to weight ratio than conventional trims such that the trim is lighter due to the use of a thinner trim. In addition to the above, in some embodiments, the polymeric material may be an elastomeric material.

Any appropriate combination of polymeric material and spray on application method may be used for applying the polymeric materials to the desired portions of the helmet shell. Examples of suitable spray on polymeric materials include, but are not limited to, polyurethane, polyurea, and blends of polyurethane and polyurea. Typically the noted polymeric materials are cured using an activator such as isocyanate. While certain representative polymers are listed above, it should be understood that other spray on polymeric materials may also be used.

The above-noted polymeric materials may be applied using a standard sprayer system appropriately rigged for a helmet application. Systems for spraying polymeric materials onto a surface may include separate tanks for a polymer resin mixture and an activator. The separate materials are forced through a mixing section of a spray gun nozzle and are subsequently atomized and sprayed onto a desired surface at high pressure. After spraying the material onto the desired surface, a flushing agent may be immediately activated to clear the materials from the spray gun and avoid clogging of the system. As noted above, the gel and cure times of the polymeric material are selected such that there is sufficient time after mixing of the polymer resin and activator to spray the polymeric material onto a desired surface while avoiding clogging of the system and running or dripping of the polymeric material. To ensure appropriate application temperatures, the polymer resin mixture and activator are generally heated either in the tanks and/or in the lines connecting the tanks to an applicator nozzle. It should be noted that most spray on polymeric materials undergo an exothermic curing process. Without wishing to be bound by theory, the short cure times of these spray on polymeric materials coupled with the exothermic reaction and hot application result in elevated application temperatures for the sprayed on polymeric materials. Consequently, in some embodiments, the operating temperatures, cure times, the base helmet shell materials, the spray on polymeric materials, and/or other appropriate design considerations may be selected to ensure that the application temperature is compatible with the base material of the helmet shell. Additionally, and without wishing to be bound by theory, the elevated application temperature of the polymeric material may also beneficially lead to enhanced bonding between the polymeric material and the underlying helmet shell due to mechanisms such as enhanced diffusion of the polymers at the bonding interface at these elevated temperatures. It should be understood that other bonding mechanisms are also possible and expected.

The polymeric material layer may be applied using a spray gun or nozzle. Further, different spray guns and/or nozzles might be used for applying the polymeric material to different portions of the helmet shell depending on the desired deposition characteristics. For example, the nozzle, deposition pressure, resin temperature, and other appropriate processing parameters may be selected to alter the rate of deposition, the dispersion of the sprayed material, and/or the surface finish of the material. The deposition of the polymeric material layer may also be accomplished using automated methods, semiautomated methods, or manual methods as the current disclosure is not limited in this fashion.

In some embodiments, a pretreatment of the helmet shell is unnecessary prior to application of the sprayed on polymeric material layer. Alternatively, in some embodiments, the helmet shell may be subjected to a pretreatment to either enhance bonding of the polymeric material layer, or remove contaminants such as oils which might interfere with the bonding of the polymeric material layer. For example, the helmet shell might be subjected to cleaning by solvents compatible with the helmet shell materials such as ethanol. After any appropriate pretreatment steps are completed, and as described in more detail below, the helmet shell may be masked using any appropriate method and the polymeric material may subsequently be applied.

Turning now to the figures, an embodiment related to the deposition of the above-noted polymeric materials to a combat helmet is described. However, it should be understood that the current disclosure is not limited to only combat helmets and may be used with any appropriate helmet including, but not limited to, motorcycle helmets, bike helmets, skateboard helmets, and snowboard helmets to name a few.

Figure 1:
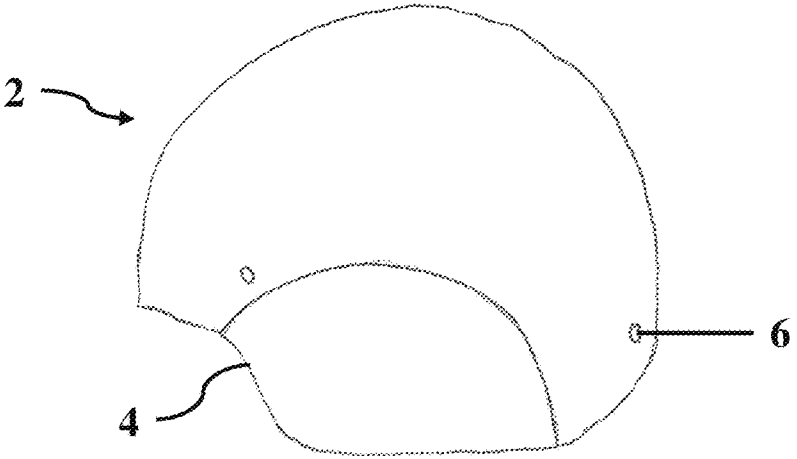
FIG. 1 is a schematic side plan view of a bare helmet shell.

FIGS. 1 and 2 depict a side view and a rear view of a helmet shell 2 for a combat helmet. The depicted helmet shell 2 includes a helmet shell edge 4 and one or more mounting locations 6. In the depicted embodiment, the helmet shell edge 4 continuously extends along the entire bottom boundary of the helmet shell 2. However, it should be understood that the current disclosure is not limited to only the particular helmet shell depicted in the figures, and instead can be used with any appropriate helmet shell geometry. With regards to the mounting locations 6, the mounting locations 6 correspond to positions for mounting accessories to the helmet shell when in use. For example, accessories such as a battery, camera, goggles, night vision goggles, a chinstrap, and other appropriate accessories might be attached to the helmet shell at the mounting locations 6. The mounting locations 6 may be located on any appropriate portion of the helmet shell and may be adapted to accept any appropriate attachment method for an associated accessory including, but not limited to, threaded fasteners, rivets, mounting rails, magnetic attachment points, and hook and loop fasteners.

Figure 4:
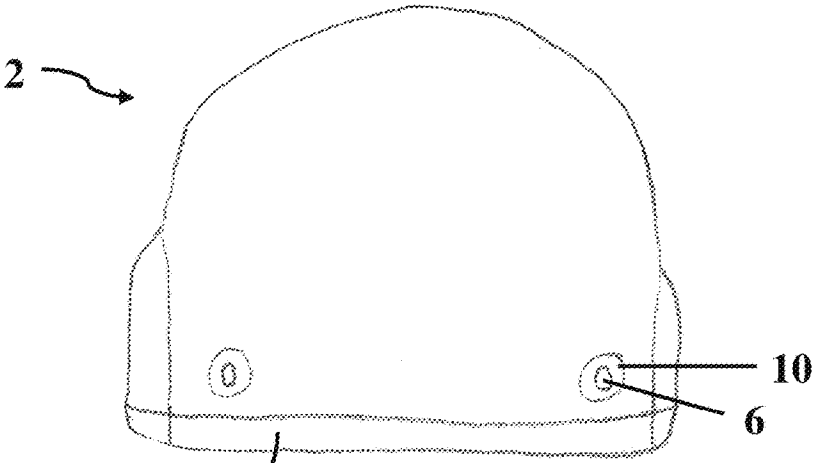
FIG. 4 is a schematic rear plan view of a helmet shell including a layer of polymeric material applied to selected portions.
Figure 3:
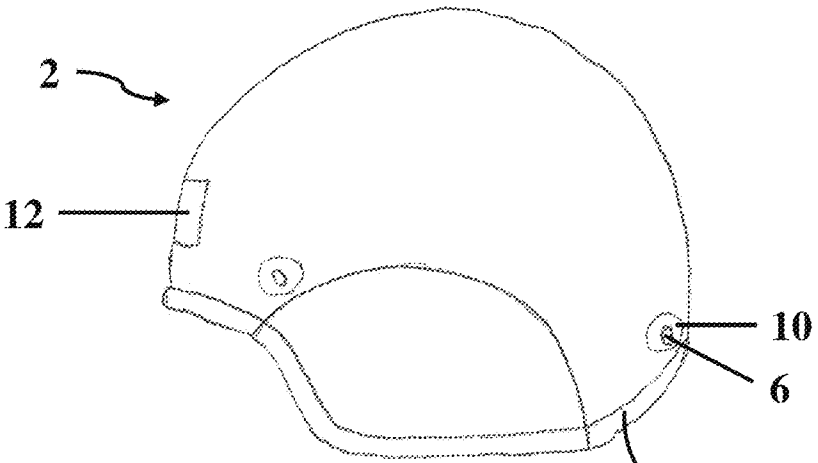
FIG. 3 is a schematic right plan view of a helmet shell including a layer of polymeric material applied to selected portions.

FIGS. 3 and 4 depict the helmet shell 2 of FIGS. 1 and 2 after a polymeric material has been applied to form a trim 8 along the helmet shell edge 4. In the depicted embodiment, the trim 8 is disposed along the entire length of the helmet shell edge 4. However, embodiments in which the trim 8 is only applied to a portion of the helmet shell edge 4 are also possible. Since the layer of polymeric material is applied directly to the helmet shell, the resulting trim substantially conforms to a shape of the underlying helmet shell 2 and does not include a seam line as would be present on a pre-molded trim. Additionally, and without wishing to be bound by theory, unlike a rubber gasket which is made for a specific helmet shell thickness and is deformed to follow the helmet shell edge 4, the sprayed on polymeric material may be applied to any shell geometry with any desired shell thickness. The sprayed on polymeric material may also be applied without the need to deform the material and consequently is substantially stress free while also exhibiting substantially continuous coverage and conforming to the shape of the underlying helmet shell. Again without wishing to be bound by theory, it may be beneficial for the polymeric material to be substantially stress free, conform to the underlying helmet shell, and exhibit continuous coverage along the desired portions of the helmet shell since this may help to reduce the possibility of the trim delaminating from the helmet shell during subsequent usage.

While the deposited polymeric material may be substantially stress free, it should be understood that some stresses may be present in the deposited polymeric material due to thermal mismatch between the polymeric material and the helmet shell as well as stresses formed in the polymeric material during curing. To help mitigate these stresses, in some embodiments, the polymeric material may have a coefficient of thermal expansion that is similar to a coefficient of thermal expansion of the underlying helmet shell to reduce the thermal mismatch between the polymeric material and the helmet shell.

In addition to the trim 8 deposited on the helmet shell 2, the figures also depict the spray on application of polymeric material to other selected portions 10 and 12 of the helmet shell. In one embodiment, the depicted portions of the helmet shell 10 and 12 are associated with various mounting locations on the helmet shell 2 as well as positions associated with mounted accessories. For example, portion 10 corresponds to a patch of polymeric material applied directly on, or around, the mounting locations 6. Alternatively, a patch of polymeric material might be applied to only a portion of the helmet shell surrounding the mounting locations 6. In such an embodiment, the patch of polymeric material might be applied to the helmet shell above a mounting location though other locations are also possible. Additionally, and as illustrated by portion 12, the polymeric material may be applied to portions of the helmet shell which correspond to positions of mounted accessories or attachment systems instead of the mounting locations themselves. For example, in the depicted embodiment, portion 12 is a patch of polymeric material applied to a portion of the helmet shell corresponding to the position of a front accessory mount that is retained by mounting features located on another portion of the helmet shell, not depicted.

In the above embodiment, the polymeric material applied to portions 10 and 12 has a coefficient of friction that is greater than the coefficient of friction of the underlying helmet shell and/or typical paints and finishes that might be used. Since many of the mounting methods rely on friction between either the mounting attachment and the helmet shell, or the mounted accessory and the helmet shell, the increased coefficient of friction may lead to a more secure mounting of the attached accessories. While specific rear, side, and front mounting locations have been depicted in the figures, other mounting locations are also possible. Without wishing to be bound by theory, similar to the trim 8, the portions 10 and 12 will also substantially conform to the shape of the underlying helmet shell and be substantially free of stresses which may help to reduce the possibility of the patches delaminating from the helmet shell as noted above.

Figure 5:
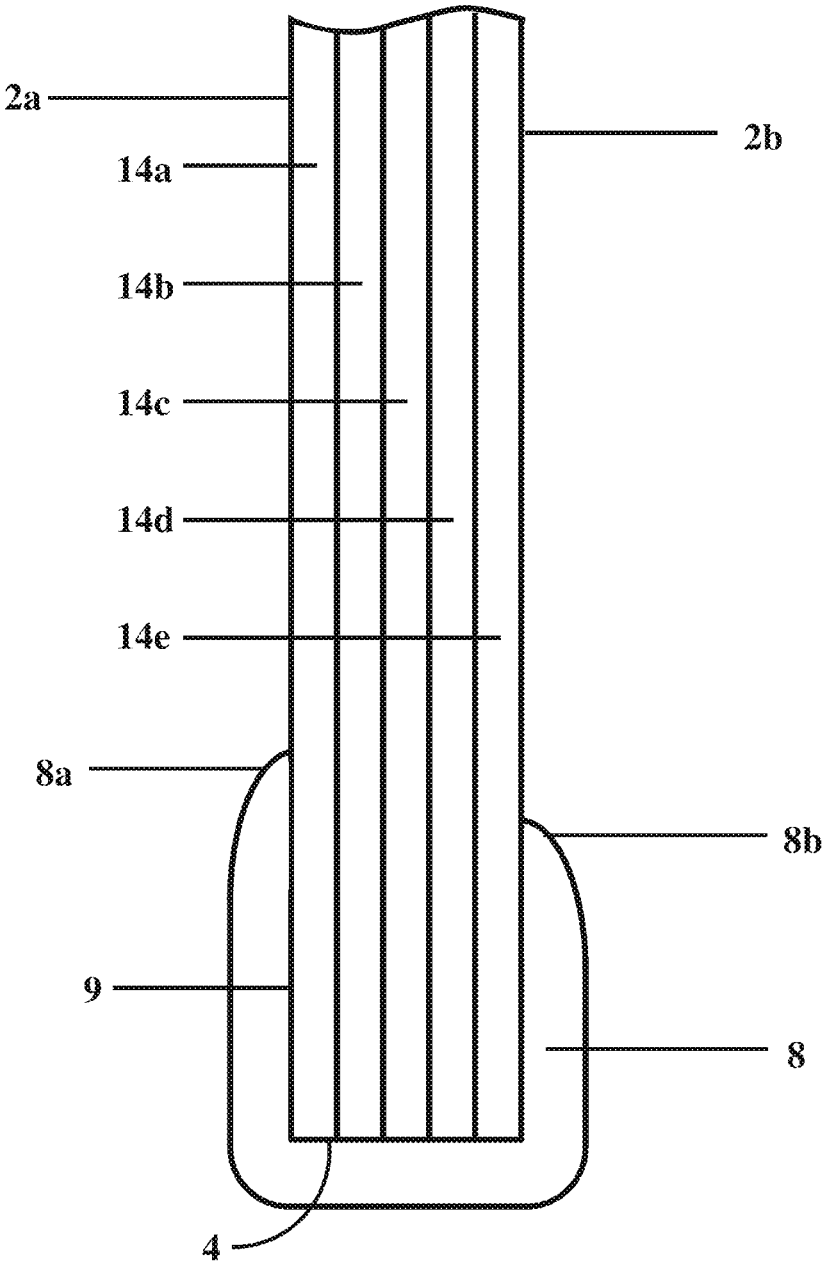
FIG. 5 is a schematic cross-sectional view of a helmet shell edge and trim.

FIG. 5 depicts a schematic representation of a cross-section of the helmet shell and the trim 8 along the helmet shell edge 4. In the depicted embodiment, the helmet shell includes an exterior surface 2*a* and an interior surface 2*b*. Depending on the embodiment, the helmet shell may be a layered composite material. For example, and as depicted in the figure, the helmet shell may comprise a plurality of laminated layers 14*a*-14*e*. The layers may correspond to mat layers, woven fabrics, fibers, or other appropriate composite materials. These layers may include materials such as: carbon fibers; fiberglass; carbon nanotubes; high strength oriented polymers such as para-aramids, ultra high molecular weight polyethylene, and other polymers; and other appropriate materials. The various material layers may be bonded in any appropriate manner including, but not limited to, resins, pre-impregnation with a binder, and separate adhesive layers. While a laminated structure is described above, it should be understood that other composite structures are also possible as the current disclosure is not limited to use with helmet shells formed from laminated composite materials.

In the embodiment depicted in FIG. 5, the trim 8 is applied to the helmet shell such that it is disposed on and surrounds the helmet shell edge 4. Consequently, the trim 8 is applied to the actual helmet shell edge 4 as well as portions of the exterior surface 2*a* and the interior surface 2*b* adjacent to the helmet shell edge 4. In addition to the above, in some embodiments, the thickness of the trim 8 may be substantially the same along the interior 2*b* and exterior surfaces 2*a* as well as the helmet shell edge 4. Alternatively, in some embodiments, it may be desirable to have a portion of the trim 8 that is thicker than the other portions. For example, the lower portion of the trim might be thicker than the side portions of the trim to provide additional protection to the laminated layers of the helmet shell.

The trim 8 may extend upwards to any appropriate height along the exterior surface 2*a* and the interior surface 2*b*. For example, the trim 8 may extend up from the helmet shell edge by approximately one inch. The trim may also have heights along the exterior surface 2*a* and the interior surface 2*b* that are the same, taller on the exterior surface, or taller on the interior surface as the current disclosure is not limited in this manner. In one specific embodiment, and as depicted in FIG. 5, the trim 8 extends to a greater height along the exterior surface 2*a* as compared to the height of the trim on the interior surface 2*b*. In related embodiments, the cross-sections of the depicted trim on both the exterior surface 2*a* and the interior surface 2*b* include tapered edges 8*a* and 8*b* that run along the entire helmet shell edge 4. Alternatively, in some embodiments, the helmet shell may be masked in an appropriate fashion to permit the spray on deposition of a trim without a tapered edge. Without wishing to be bound by theory, the tapered edges obtainable using the spray on application of the polymeric material may help to reduce stress concentrations between the helmet shell and the trim 8.

Figure 7A:
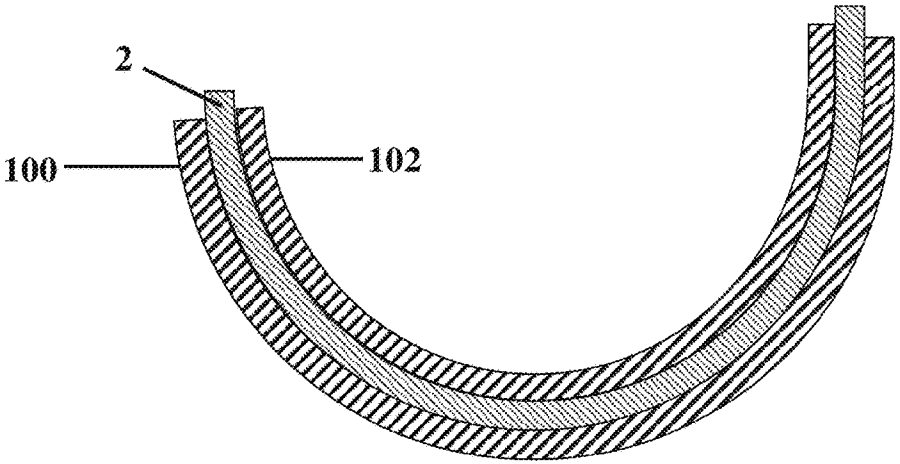
FIG. 7A is a schematic cross-sectional view of a helmet shell and associated inner and outer masks.
Figure 7B:
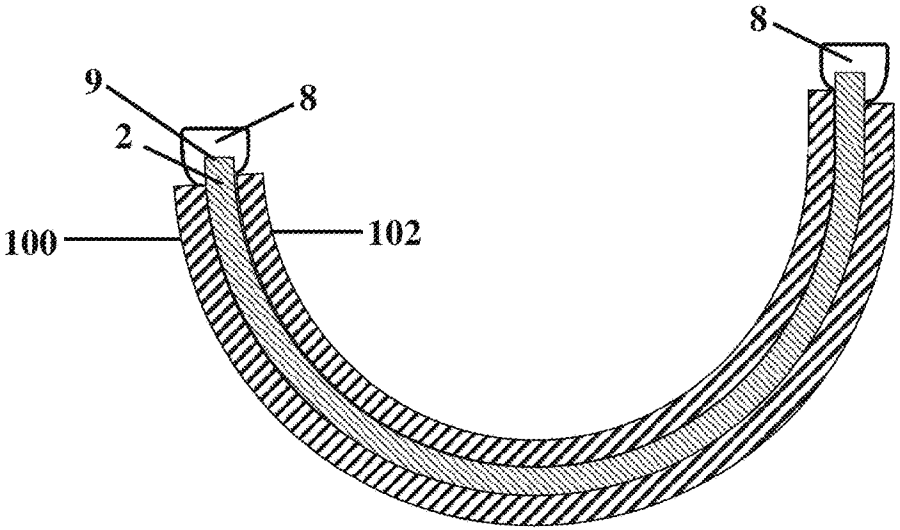
FIG. 7B is a schematic cross-sectional view of a helmet shell and associated inner and outer masks after a trim has been applied.
Figure 6:
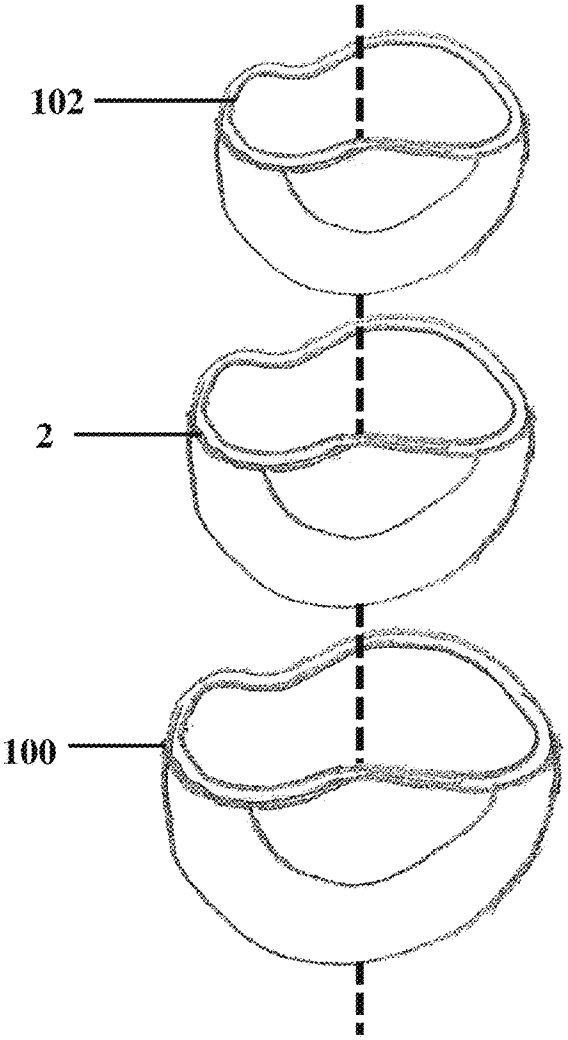
FIG. 6 is a schematic exploded perspective view of a helmet shell and associated inner and outer masks.

As depicted in FIGS. 6-7B, an outer mask 100 and inner mask 102 may be assembled with the helmet shell 2 to define the shape and location of portions of the helmet shell 2 where the polymeric material will be applied. Consequently, in the depicted embodiment, the outer mask 100 and inner mask 102 substantially conform to the shape of the helmet shell 2 to limit application of the polymeric material to the desired portions of the helmet shell. For example, and as best illustrated in FIGS. 7A and 7B, the outer mask 100 and inner mask 102 are arranged such that they block certain portions of the helmet shell. Subsequent to positioning the helmet shell 2 and the associated outer mask 100 and inner mask 102, the polymeric material may be sprayed onto the exposed portions of the helmet shell 2 to form features such as the trim 8 disposed on the helmet shell edge 4, as illustrated in FIG. 7B. After spraying the polymeric material onto the desired portions of the helmet shell, the inner and outer masks may be removed from the helmet shell. In addition to leaving the helmet shell edge 4 exposed for forming the trim 8, in some embodiments, the outer mask 100 and inner mask 102 may also include other unmasked areas to deposit the polymeric material onto other portions of the helmet shell. For example, outer mask 100 may include unmasked areas corresponding to the mounting locations noted above in addition to forming the trim 8 along the helmet shell edge 4.

While specific inner and outer masks are described above, other masking techniques and specific types of masks may be used as the current disclosure is not limited to any particular masking method or system. For example, in one embodiment the helmet shell 2 is inserted into a cavity and a corresponding inner mask is inserted into the helmet shell. Alternatively, either one, or both, of the inner and outer mask may be a disposable mask. In yet another embodiment, either one, or both, of the inner and outer mask may be a collapsible mask. It should be understood, that combinations of the above and other masking techniques may also be used. Further, masking of the helmet shells may be done using automated, semi-automated, or manual processes as the current disclosure is not limited in this fashion.

In the embodiments described above, the polymeric material layer is adhered directly to the helmet shell without any adhesive or other intermediate layer. However, in some embodiments, the helmet shell includes an intermediate non-adhesive layer 9 disposed between an underlying base material of the helmet shell and the polymeric material layer. This may be of use in instances where the polymeric material is not adherent to the underlying material of the helmet shell, but it is adherent to the material of the intermediate non-adhesive layer 9. In other embodiments, the intermediate layer might be selected for a desired property such as chemical, flammability, and/or abrasion resistance. In such an embodiment, subsequent to the application of the intermediate non-adhesive layer to an underlying base material of the helmet shall, the polymeric material layer is sprayed on top of the intermediate non-adhesive layer. In some embodiments, this intermediate non-adhesive layer is formed as part of the helmet shell manufacturing process such that it is part of the helmet shell.

In addition to the bond between the polymeric material and the underlying helmet shell, in some embodiments, mechanical features are also provided on a surface of the helmet shell corresponding to locations of the sprayed on polymeric material. For example, the helmet shell might include a molded rim, projections, grooves, a roughened surface, or any other appropriate feature in a location corresponding to the sprayed on polymeric material. Without wishing the bound by theory, due to the sprayed on application of the polymeric material, the polymeric material will substantially conform to the underlying mechanical feature formed on the helmet shell and may result in enhanced bonding and retention of the polymeric material to the helmet shell.

In some embodiments, it is desirable to alter the characteristics of the applied polymeric material to improve a particular property such as the chemical, flammability, and/or abrasion resistance of the polymeric material. The polymeric material may include additives and/or composite materials to increase one of the above-noted resistances of the material. For example, additives such as bromine-based flame retardants, chlorine-based flame retardants, and other appropriate flame retardant additives might be added to the polymeric material to enhance the fire resistance and/or self-extinguishing properties. In one specific embodiment, tri-chloral-propal-phosphate is added to increase the self-extinguishing properties of the polymeric material. In other embodiments, the abrasion resistance of the material might be enhanced through the use of appropriate fillers such as carbon fibers, para-aramid fibers, carbon nanotubes, ceramic particles, ceramic fibers, and other appropriate materials. While specific examples are noted above, it should be understood that any appropriate additive or filler material might be used to alter the desired properties of the polymeric material applied to the helmet shell.

Example: Spray Application of a Polymeric Material Layer

A helmet shell including a molded rim located along the helmet shell edge was used during initial testing of the sprayed on polymeric materials. The molded rim was located on both the interior and exterior surfaces of the helmet shell. A polymeric material made from a blend of polyurethane and polyurea (Line-X XS-100) was sprayed onto the entire bottom boundary of the helmet shell as well as the adjacent interior and exterior vertical surfaces of the helmet shell to form a trim along the helmet shell edge. The resulting trim was adequately bonded to the underlying helmet shell without the need for adhesive. Additionally, the trim exhibited continuous coverage along the selected portions of the helmet shell, conformed to the contours of the underlying helmet shell, was faster to apply than conventional trims, was lighter than conventional trims by about 33%, and did not include a seam.

Example: Adhesion and Peel Testing

Helmet samples including helmet trims similar to that described above were prepared and subjected to adhesion and peel testing to determine if the presently disclosed spray on polymeric materials meet applicable standards for military helmets.

During the initial inspection, the helmet trim was firmly attached to the helmet shell. Further, no peeling, or lifting off, of portions of the helmet trim from the underlying helmet shell were observed.

After the initial inspection, one helmet was aged at 160° F. for four hours. The applicable military design requirement is that the helmet trim should peel back no more than 0.25 inches after the heat treatment. The currently disclosed spray on trim comprising a polyurethane and polyurea blend exhibited an average peel back length of approximately 0.047 inches along the helmet shell edge.

In addition to the initial inspection and heat treatment testing, there is also a design requirement that the helmet trim should not lift off of the underlying helmet shell when the portion of the helmet including the helmet trim is cut into squares. When the portion of a helmet including the helmet trim was cut into squares, there was no peeling or lift off of the helmet trim observed along the cut edges. Without wishing to be bound by theory, this appears to indicate that the bond between the spray on helmet trim and the helmet shell is both uniform and robust along the entire helmet edge.

Example: Flammability Testing

A helmet sample including a helmet trim similar to that described above was also prepared and subjected to flammability testing. The helmet was conditioned at 21° C. and 65% relative humidity in preparation for the flammability testing. The flammability testing was conducted using methane gas, and the flame was applied for 12 seconds. After the application of the flame, the helmet was observed for any after flames.

The flammability testing was conducted on various portions of the helmet including portions with the helmet trim. The military design requirement is that there are no after flames greater than two seconds subsequent to the flame application. No after flames were observed either on the helmet, or the helmet trim after the flame was applied for 12 seconds.

Testing Summary

In view of the above, the currently disclosed spray on helmet trims meet or exceed the noted design requirements for a combat helmet. Consequently, the currently disclosed spray on polymeric materials are appropriate both for military and nonmilitary helmet applications.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A method of manufacturing a helmet, the method comprising:

spraying a material onto a helmet shell edge of a helmet shell to form a trim along the helmet shell edge, wherein the trim formed along the helmet shell edge covers the helmet shell edge and a portion of each of an exterior surface of the helmet shell and an interior surface of the helmet shell adjacent to the helmet shell edge, and wherein an adjacent portion of the interior surface and an adjacent portion of the exterior surface is free of the material.

2. The method of claim 1, wherein the material comprises a polymeric material.

3. The method of claim 2, wherein the polymeric material comprises at least one of polyurethane and polyurea.

4. The method of claim 2, wherein the polymeric material cures after it is sprayed on the helmet shell.

5. The method of claim 1, wherein spraying the material further comprises spraying a mixture of a polymeric resin and an activator.

6. The method of claim 5, further comprising mixing the mixture of the polymeric resin and the activator during spraying.

7. The method of claim 1, further comprising masking a portion of the helmet shell prior to spraying the material to limit application of the material to only form the trim along the helmet shell edge.

8. The method of claim 7, wherein masking the portion of the helmet shell includes masking an interior portion of the helmet shell and masking an exterior portion of the helmet shell at the same time.

9. The method of claim 7, wherein masking the portion of the helmet shell includes masking the portion of the helmet shell with a collapsible mask.

10. The method of claim 1, further comprising applying an intermediate non-adhesive layer to an underlying base material of the helmet shell prior to spraying the material onto the helmet shell.

11. The method of claim 1, further comprising:

spraying a material onto a portion of an exterior surface of a helmet shell associated with either a mounting location for mounting an accessory or a position for a mounted accessory, wherein a coefficient of friction of the material is greater than a coefficient of friction of an adjacent portion of the exterior surface of the helmet shell free of the material, wherein the material comprises a polymeric material, and wherein the polymeric material cures after it is sprayed on the helmet shell.

12. The method of claim 11, wherein the polymeric material comprises at least one of polyurethane and polyurea.

13. The method of claim 11, further comprising applying an intermediate non-adhesive layer to an underlying base material of the helmet shell prior to spraying the material onto the helmet shell.

14. The method of claim 1, wherein spraying the material onto the helmet shell includes spraying a continuous layer of material onto the helmet shell edge, the portion of the interior surface of the helmet shell, and the portion of the exterior surface of the helmet shell.

15. The method of claim 14 wherein spraying the continuous layer onto the helmet shell conforms the material to a shape of the helmet shell without a seam line.

16. The method of claim 1, wherein the helmet shell includes a mounting location for mounting an accessory separate from the trim, and further comprising spraying the material onto the exterior surface of the helmet shell at the mounting location, and wherein an adjacent portion of the exterior surface of the helmet shell surrounding the mounting location is free of the material.

17. A method of manufacturing a helmet, the method comprising:

assembling an inner mask to an interior surface of a helmet shell;

assembling an outer mask to an exterior surface of the helmet shell; and spraying a material onto a helmet shell edge, an unmasked portion of the interior surface, and an unmasked portion of the exterior surface of the helmet shell while the inner mask and the outer mask are assembled with the helmet shell at the same time to form a trim along the helmet shell edge.

18. The method of claim 17, wherein the trim formed along the helmet shell edge covers the helmet shell edge and a portion of each of an exterior surface of the helmet shell and an interior surface of the helmet shell adjacent to the helmet shell edge without a seam line.

19. The method of claim 18, wherein an adjacent portion of the interior surface and an adjacent portion of the exterior surface is free of the material.

20. The method of claim 17, wherein the material comprises a polymeric material.

21. The method of claim 20, wherein the polymeric material cures after it is sprayed on the helmet shell.

22. The method of claim 17, wherein spraying the material onto the helmet shell includes spraying a continuous layer of material onto the helmet shell edge, the unmasked portion of the interior surface of the helmet shell, and the unmasked portion of the exterior surface of the helmet shell.

23. The method of claim 17, wherein the helmet shell includes a mounting location for mounting an accessory separate from the trim, and further comprising spraying the material onto the exterior surface of the helmet shell at the mounting location, and wherein an adjacent portion of the exterior surface of the helmet shell surrounding the mounting location is free of the material.

* * * * *